United States Patent [19]

Mariol

[11] Patent Number: 4,968,091

[45] Date of Patent: Nov. 6, 1990

[54] ARTICLE USEFUL AS BOOSTER CHAIR AND AS STEP STOOL

[76] Inventor: John V. Mariol, 7163 Honeywood Ct., Cincinnati, Ohio 54230

[21] Appl. No.: 388,695

[22] Filed: Aug. 2, 1989

[51] Int. Cl.[5] ..... A47C 13/00

[52] U.S. Cl. ..... 297/3; 297/439; 297/250; 297/457

[58] Field of Search ..... 297/1, 2, 3, 283, 428, 297/438, 439, 250, 457; 248/188.8, 188.9

[56] References Cited

U.S. PATENT DOCUMENTS

| | | | |
|---|---|---|---|
| D. 144,404 | 4/1946 | Mabry | 297/3 X |
| 2,440,979 | 5/1948 | Schneider | 297/3 |
| 2,458,621 | 1/1949 | Miller | 248/188.9 X |
| 2,622,658 | 12/1952 | Morgan | 297/2 X |
| 3,556,586 | 1/1971 | Beardmure | 297/3 |
| 3,982,784 | 9/1976 | Esser | 297/1 |
| 4,241,949 | 12/1980 | Parker | 297/3 |
| 4,521,052 | 6/1985 | Cone | 297/3 |

FOREIGN PATENT DOCUMENTS

| | | | |
|---|---|---|---|
| 28653 | 2/1957 | Finland | 297/1 |

*Primary Examiner*—José V. Chen

*Attorney, Agent, or Firm*—Dressler, Goldsmith, Shore, Sutker & Milnamow, Ltd.

[57] ABSTRACT

An article useful alternatively as a booster chair with a high back for a small child, in a first orientation, or as a step stool, in a second orientation. The article has a seat portion, a back portion, and two side portions. The seat, back, and side portions are molded from a polymeric material, as a single part, defining a seating cavity with a high back. The seating cavity is adapted to seat a small child in the first orientation. The single part also defines a step. The article is adapted to support a person on the step in the second orientation. The article is provided with two sets of skid-resistant feet, one set for each such orientation of the article.

9 Claims, 2 Drawing Sheets

FIG. 3
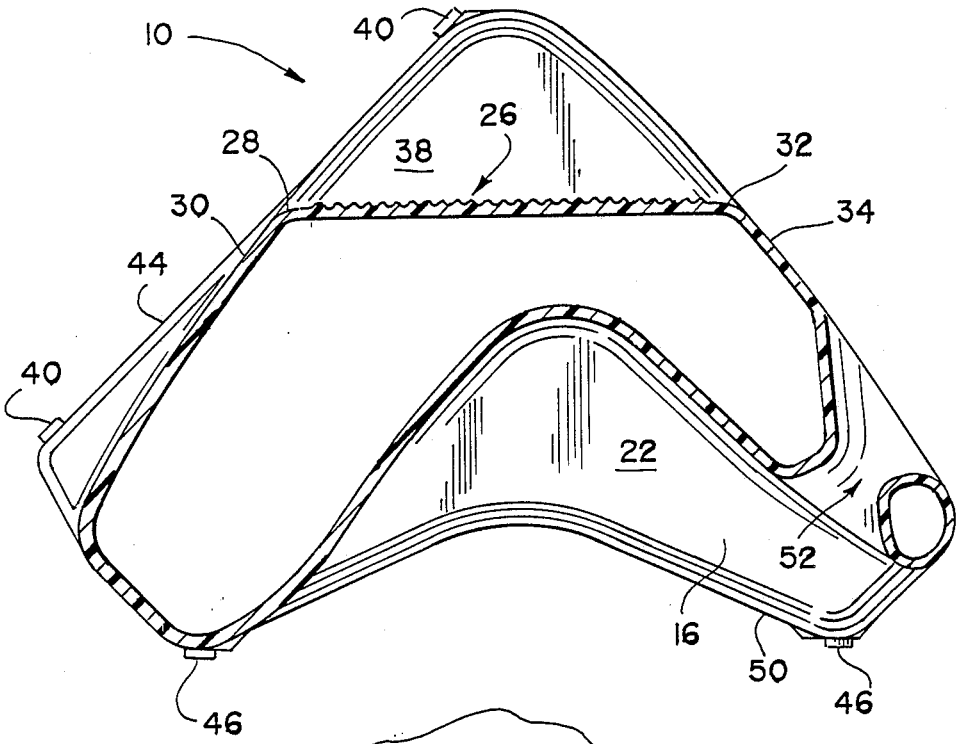
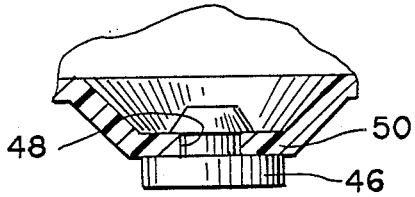
FIG. 4
FIG. 5
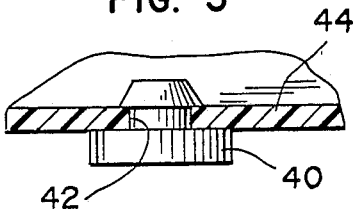

ARTICLE USEFUL AS BOOSTER CHAIR AND AS STEP STOOL

TECHNICAL FIELD OF THE INVENTION

The invention pertains to a novel article with dual uses. The article is useful alternatively as a booster chair with a high back for a small child, in a first orientation of the article, and as a step stool for a child or an adult, in a second orientation of the article.

BACKGROUND OF THE INVENTION

A booster chair for a small child is a commonplace article in households, in restaurants, and elsewhere where small children are found. It is known to mold such a typical chair from a polymeric material so as to have a seat portion, a back portion of a given height, and two side or arm portions of an equal height. Typically, if molded from a polymeric material, such a chair has one recommended or intended use. Such use is to support a small child seated in the chair.

A step stool providing a single step is another article found frequently in households and elsewhere. It is known to mold such a stool from a polymeric material. Typically, if molded from a polymeric material, such a stool has one recommended or intended use. Such use is to support a person stepping onto the step provided by the stool. Its shape discourages or prevents its use as a booster chair. Although a small child might sit on such a stool, it would not support the child's back.

Typically, heretofore, booster chairs and step stools have been regarded as disparate articles having no interrelationship.

SUMMARY OF THE INVENTION

This invention provides a novel article with dual uses. The article is useful alternatively as a booster chair with a high back for a small child, in a first orientation of the article, and as a step stool for a child or an adult, in a second orientation of the article.

The article is shaped so as to rest firmly on a substantially horizontal surface in either orientation. As an example, in the first orientation of the article, a rigid seat of a larger chair may provide the substantially horizontal surface. In the second orientation of the article, a rigid floor typically provides the substantially horizontal surface.

The article is shaped so as to have a seat portion and a back portion. The back portion is joined integrally to the seat portion. Also, the article may have two side portions. If provided, the side portions are joined integrally to the seat and back portions. The seat and back portions, along with the side portions if provided, define a seating cavity with a high back.

The high back of the seating cavity is adapted to support the back of a small child seated in the seating cavity in the first orientation of the article. A high back is desirable in a booster chair for a small child for the comfort and safety of the child.

The seating cavity opens upwardly and frontwardly when the article is rested on a substantially horizontal surface in its first orientation. Thus, the seat portion extends generally horizontally and faces generally upwardly. Also, the back portion extends generally vertically and faces generally frontwardly.

The seating cavity opens downwardly when the article is rested on a substantially horizontal surface in its second orientation. Thus, the seat portion faces backwardly and downwardly. Also, the back portion faces frontwardly and downwardly.

The article is shaped so as to define a step. The step extends substantially horizontally and faces substantially upwardly when the article is rested on a substantially horizontal surface in its second orientation. The step faces downwardly and backwardly when the article is rested on such a surface in its first orientation. The article is adapted to support a person on the step in its second orientation.

In a preferred construction, the seat portion defines a front edge of the step and extends frontwardly and downwardly from the front edge of the step in the second orientation of the article. In the same construction, the back portion defines a back edge of the step and extends backwardly and downwardly from the back edge of the step in the second orientation of the article. Moreover, the side portions mentioned above define two side edges of the step and extend upwardly from the side edges in the second orientation of the article.

Preferably, the seat and back portions, along with the side portions if provided, are molded from a polymeric material. Preferably, such portions are molded as a single piece, which defines the step. Such portions may be alternatively molded as three separate pieces.

In the preferred construction, the article is provided with a first set of skid-resistant feet. The feet of the first set are adapted to rest on a substantially horizontal surface in the first orientation of the article. In the same construction, the article is provided with a second set of skid-resistant feet. The feet of the second set are adapted to rest on a substantially horizontal surface in the second orientation of the article.

These and other objects, features, and advantages of this invention are evident from the following description of a preferred embodiment of this invention with reference to the accompanying drawings.

BRIEF DESCRIPTION OF THE DRAWINGS

FIG. 3 is a sectional view taken along line 3—3 of FIG. 2, in a direction indicated by arrows.

FIGS. 4 and 5 are a fragmentary, sectional views taken respectively along line 4—4 of FIG. 2 and line 5—5 of FIG. 1, in the directions indicated by arrows.

DETAILED DESCRIPTION OF PREFERRED EMBODIMENT

Figure 1:
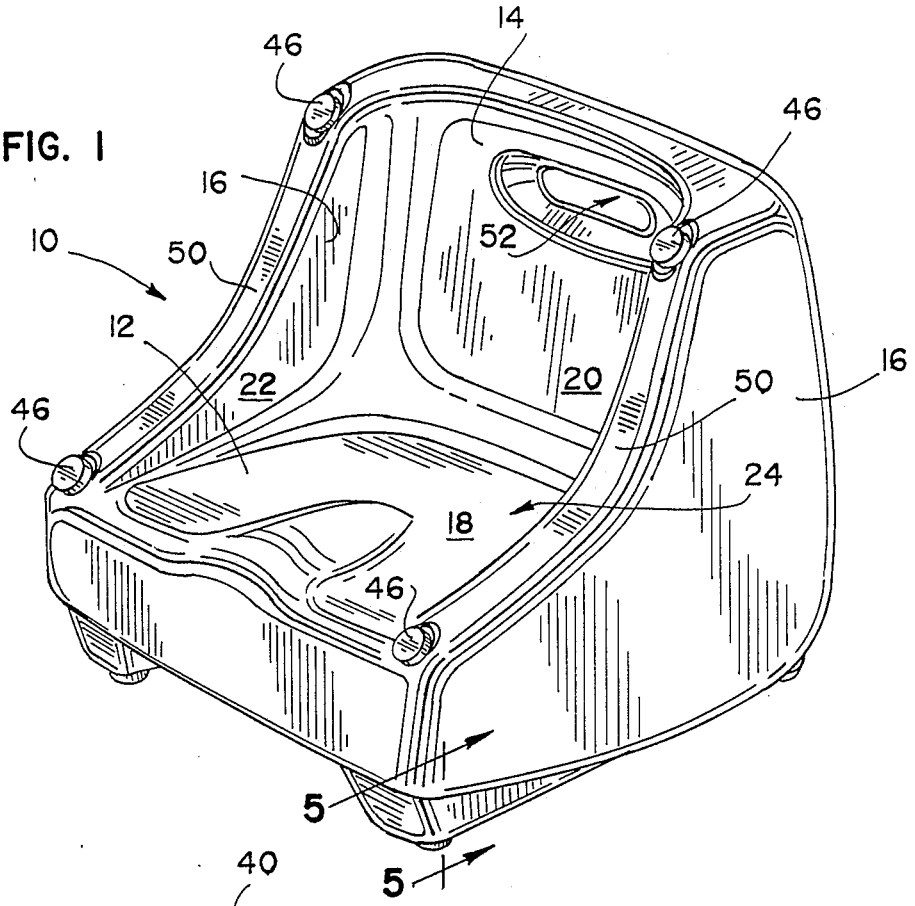
FIG. 1 a perspective view of an article constituting a preferred embodiment of this invention, in a first orientation, in which the article is useful as a booster chair with a high back for a small child.
Figure 2:
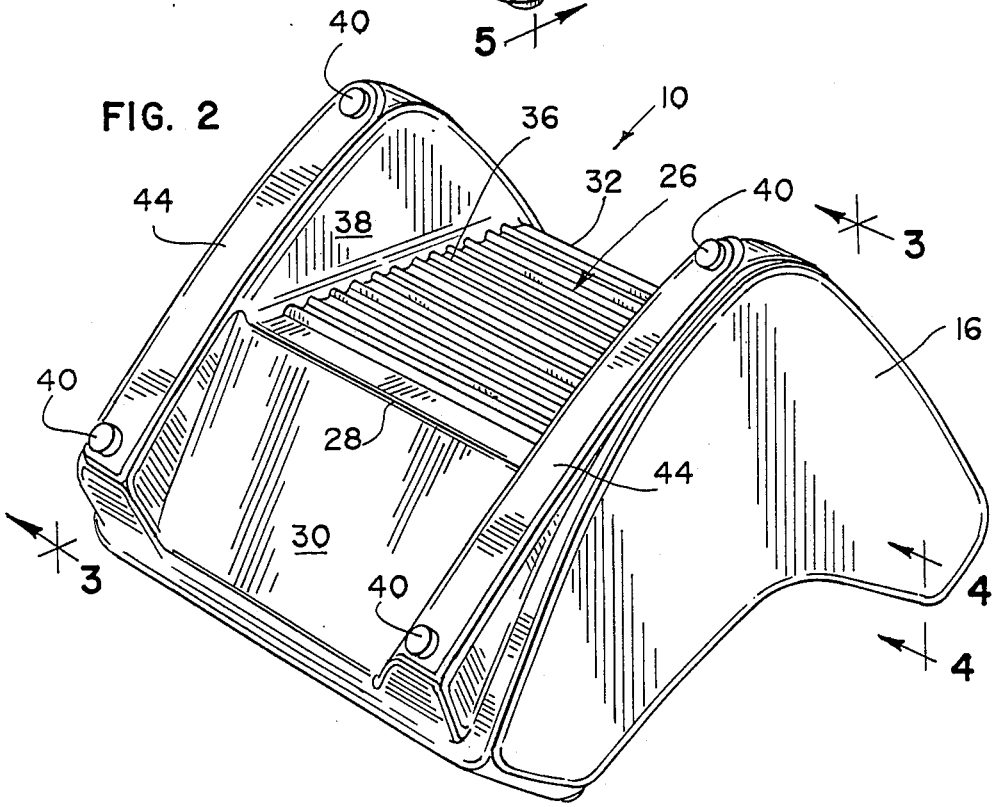
FIG. 2 is a perspective view of the same article, in a second orientation, in which the article is useful as a step stool for a child or an adult.

As shown in the drawings, an article 10 with dual uses constitutes a preferred embodiment of this invention. The article 10 is useful as a booster chair with a high back for a small child, in a first orientation, in which the article 10 is shown in FIG. 1. The article 10 is useful as a step stool for a child or an adult, in a second orientation, in which the article 10 is shown in FIGS. 2 and 3.

The article 10, which is hollow, can be blow molded or rotationally molded (roto-molded) from a polymeric material, as a single piece, or as three separate pieces. High density polyethylene is a preferred material for the article 10. Polypropylene is an alternative material for the article 10.

The article 10 is shaped so as to have a seat portion 12, a back portion 14, and two side portions 16. The back portion 14 is joined integrally to the seat portion 12. The side portions 16 are joined integrally to the seat portion 12 and to the back portion 14. The seat portion 12, the back portion 14, and the side portions 16 brace each other, in either orientation of the article 10, as discussed below.

A seating cavity 24 with a high back is defined by an inner surface 18 of the seat portion 12, an inner surface 20 of the back portion 14, and inner surfaces 22 (one shown) of the side portions 16. Thus, the seating cavity 24 is adapted to seat a small child. Also, the high back of the seating cavity 24 is adapted to support the back of a small child seated in the seating cavity 24.

As shown, the seating cavity 24 opens upwardly and frontwardly when the article 10 is rested on a substantially horizontal surface in the first orientation of the article 10. Thus, the seat portion 12 extends generally horizontally and faces generally upwardly. Also, the back portion 14 extends generally vertically and faces generally frontwardly.

As shown, the seating cavity 24 opens downwardly, when the article 10 is rested on a substantially horizontal surface in the second orientation of the article 10. Thus, the seat portion 12 faces backwardly and downwardly. Also, the back portion 14 faces frontwardly and downwardly.

The article 10 is shaped so as to define a step 26. The step 26 is elevated in the second orientation of the article 10. The step 26 extends substantially horizontally and faces substantially upwardly when the article 10 is rested on a substantially horizontal surface in its second orientation. The step 26 faces downwardly and backwardly when the article 10 is rested on such a surface in its first orientation.

A front or forwardly facing edge 28 of the step 26 is defined where the step 26 meets an outer surface 30 of the seat portion 12. The step 26 is interconnected with the outer surface 30, as shown in FIG. 3, to define the front edge 28. It is evident from FIG. 3 that the outer surface 30 faces upwardly and frontwardly, and that the outer surface 30 is not higher than the step 26, when the article 10 is rested on a substantially horizontal surface in its second orientation.

A back or backwardly facing edge 32 of the step 26 is defined where the step 26 meets an outer surface 34 of the seat portion 14. The step 26 is interconnected with the outer surface 34, as shown in FIG. 3, to define the back edge 32. It is evident from FIG. 3 that the outer surface 34 faces upwardly and backwardly, and that the outer surface 34 is not higher than the step 26, when the article 10 is rested on a substantially horizontal surface in its second orientation.

The outer surfaces 30, 34, which are shown to be generally planar, define an angle with an apex where such surfaces 30, 34, would meet if such surfaces 30, 34 were extended. As shown in FIG. 3, the step 26 cuts across the apex of the angle defined by the outer surfaces 30, 34.

The side edges 36 (one shown) of the step 26 are defined where the step 26 meets adjacent surfaces 38 (one shown) of the side portions 16. Parts of the side portions 16 extend above the side edges 36, as shown in FIG. 3, in the second orientation of the article 10. The article 10 is adapted to support a child or an adult on the step 26 when the article 10 is rested on a substantially horizontal surface in its second orientation. The step 26 is ribbed, as shown, so as to help a person to obtain a secure foothold on the step 26.

The article 10 is provided with a first set of four grommets 40 of an elastomeric material, such as a synthetic rubber, and of a conventional type. The grommets 40 are snap-fitted into suitable apertures 42 (one shown in FIG. 5) in first edges 44 of the side portions 16. The grommets 40 are located approximately at four corners of what becomes the underside of the article 10 when the article 10 is rested on a substantially horizontal surface in its first orientation. The grommets 40 serve as a first set of skid-resistant feet, which are adapted to engage a substantially horizontal surface in the first orientation of the article 10. The first edges 44 of the side portions 16 extend beyond the back edge 32 of the step 26 and beneath the back portion 14, as shown, so as to enable the article 10 (via such grommets 40) to rest firmly and stably on such a surface in the first orientation of the article 10, as with a child in the seating cavity 24.

The article 10 is provided with a second set of four grommets 46 similar to the grommets 40. The grommets 46 are snap-fitted into suitable apertures 48 (one shown in FIG. 4) in second edges 50 of the side portions 16. The grommets 46 are located approximately at four corners of what becomes the underside of the article 10 when the article 10 is rested on a substantially horizontal surface in its second orientation.

The grommets 46 serve as a second set of skid-resistant feet, which are adapted to engage a substantially horizontal surface in the second orientation of the article 10. The second edges 50 of the side portions 16 are concave, as shown, so as to enable the article 10 to rest (via the grommets 46) firmly and stably on such a surface without interference from such edges 50, as with a person on the step 26.

The seat portion 12, the back portion 14, and the side portions 16 brace each other. Thus, they oppose tendencies of the article 10 to collapse when the article 10 is used in its first orientation, i.e., as a booster chair for a small child. Also, they oppose tendencies of the article 10 to collapse when the article 10 is used in its second orientation, i.e., as a step stool for a child or an adult.

The back portion 14 is formed with a wide slot 52. The slot 52 enables the article 10 to be easily carried from one place to another.

Various modifications are possible without departing from the scope and spirit of this invention.

I claim:

1. An article useful alternatively as a booster chair with a high back for a small child, in a first orientation of the article, and as a step stool for a child or an adult, in a second orientation of the article, the article being shaped so as to rest firmly and stably on a substantially horizontal surface in either orientation of the article;

the article being shaped so as to have a seat portion and a back portion joined integrally to the seat portion, the seat and back portions defining a seating cavity, the seat portion extending generally horizontally and facing generally upwardly and the back portion extending generally vertically and facing generally frontwardly when the article is rested on a substantially horizontal surface in the first orientation of the article, the seat portion having a surface facing backwardly and downwardly and the back portion having a surface facing frontwardly and downwardly when the article is rested on a substantially horizontal surface in the second orientation of the article, the seating cavity being adapted to seat a small child when the article is rested on a substantially horizontal surface in the first orientation of the article, the seating cavity having a high back, which is adapted to support the back of a small child seated in the seating cavity;

the article being shaped so as to define a step, the step extending substantially horizontally and having a surface facing substantially upwardly when the article is rested on a substantially horizontal surface in the second orientation of the article, the step surface facing downwardly and backwardly when the article is rested on a substantially horizontal surface in the first orientation of the article, the article being adapted to support a person on the step when the article is rested on a substantially horizontal surface in the second orientation of the article;

the seat portion having an outer surface, which faces upwardly and frontwardly in the second orientation of the article, the back portion having an outer surface, which faces upwardly and backwardly in the second orientation of the article, said outer surfaces being generally planar and defining an angle with an apex where said outer surfaces would meet if extended;

the step being interconnected with the outer surfaces of the seat portion to define in the second orientation of the article, a forwardly facing edge of the step where the step meets the outer surface of the seat portion, the step being interconnected with the outer surface of the back portion to define, in the second orientation of the article, a backwardly facing edge of the step where the step meets the outer surface of the back portion the step cutting across the apex of the angle defined by the outer surfaces of the seat and back portions and, the seat and back portions having their outer surfaces not higher than the step in the second orientation of the article so as to permit a person to step either edge of the step, in mounting the step or demounting therefrom, without having to step over any portion of the article higher than the step in the second orientation of the article.

2. The article of claim 1 wherein the seat and back portions are molded from a polymeric material, as a single piece, which defines the step.

3. An article useful alternatively as a booster chair for a small child, in a first orientation of the article, and as a step stool for a child or an adult, in a second orientation of the article, the article being shaped so as to rest firmly and stably on a substantially horizontal surface in either orientation of the article;

the article being shaped so as to have a seat portion, a back portion joined integrally to the seat portion, and two side portions joined integrally to the seat and back portions, the seat, back, and side portions defining a seating cavity, the seat portion extending generally horizontally and facing generally upwardly and the back portion extending generally vertically and facing generally frontwardly when the article is rested on a substantially horizontal surface in the first orientation of the article, the seat portion having a surface facing backwardly and downwardly and the back portion having a surface facing frontwardly and downwardly when the article is rested on such a substantially horizontal surface in the second orientation of the article, the seating cavity being adapted to seat a small child at an elevation above a substantially horizontal surface when the article is rested thereon in the first orientation of the article;

the article being shaped so as to define a step, the step extending substantially horizontally and having a surface facing substantially upwardly when the article is rested on a substantially horizontally surface in the second orientation of the article, the step surface facing downwardly and backwardly when the article is rested on a substantially horizontal surface in the first orientation of the article, the article being adapted to support a person on the step when the article is rested on a substantially horizontal surface in the second orientation of the article;

the seat portion having an outer surface, which faces upwardly and frontwardly in the second orientation of the article, the back portion having an outer surface, which faces upwardly and backwardly in the second orientation of the article, said outer surfaces being generally planar and defining an angle with an apex where said outer surfaces would meet if extended;

the step being interconnected with the outer surface of the seat portion to define, in the second orientation of the article, a forwardly facing edge of the step where the step meets the outer surface of the seat portion, the step being interconnected with the outer surface of the back portion to define, in the second orientation of the article, a backwardly facing edge of the step where the step meets the outer surface of the back portion, the step cutting across the apex of the angle defined by the outer surfaces of the seat and back portions and the seat and back portions having their outer surfaces not higher than the step in the second orientation of the article so as to permit a person to step across either edge of the step, in mounting the step or demounting therefrom, without having to step over any portion of the article higher than the step in the second orientation of the article.

4. The article of claim 3, wherein the side portions define two side edges of the step and have parts that extend upwardly from the step in the second orientation of the article.

5. The article of claim 3 wherein the seat, back, and side portions are molded from a polymeric material, as a single piece, which defines the step.

6. The article of claim 5 wherein the side portions define two side edges of the step and have parts that extend upwardly from the step in the second orientation of the article.

7. The article of claim 6 as provided with a first set of skid-resistant feet, which are adapted to engage a substantially horizontal surface in the first orientation of the article, and with a second set of skid-resistant feet, which are adapted to engage such a surface in the second orientation of the article.

8. The article of claim 3 as provided with at least one set of skid-resistant feet, which are adapted to engage a substantially horizontal surface in one of said first and second orientations of the article.

9. The article of claim 3 as provided with a first set of skid-resistant feet, which are adapted to engage a substantially horizontal surface in the first orientation of the article, and with a second set of skid-resistant feet, which are adapted engage such a surface in the second orientation of the article.

* * * * *